United States Patent [19]

Husted

[11] 4,279,380

[45] Jul. 21, 1981

[54] MAIL BOX SIGNAL UNIT

[76] Inventor: Douglas P. Husted, 909 Rose La., Hatfield, Pa. 19440

[21] Appl. No.: 117,262

[22] Filed: Jan. 31, 1980

[51] Int. Cl.[3] ..... B65D 91/00

[52] U.S. Cl. ..... 232/35

[58] Field of Search ..... 232/34, 35

[56] References Cited

U.S. PATENT DOCUMENTS

| | | | |
|---|---|---|---|
| 2,581,880 | 1/1952 | Price | 232/35 |
| 2,609,787 | 9/1952 | Lawson | 232/35 |
| 2,808,982 | 10/1057 | Armstrong | 232/35 |
| 3,547,070 | 12/1970 | Schuh | 232/35 X |
| 3,650,464 | 3/1972 | Lewis | 232/35 |

*Primary Examiner*—Roy D. Frazier
*Assistant Examiner*—Peter A. Aschenbrenner
*Attorney, Agent, or Firm*—Raymond Underwood

[57] ABSTRACT

A signal unit which is attached to a mailbox to indicate that its door has been opened is made up of a plate which is frictionally held up against the underside of the box by a spring and a lip that bears on the door.

5 Claims, 4 Drawing Figures

MAIL BOX SIGNAL UNIT

This invention relates to postal mailboxes and particularly to one which will automatically display a signal that the postman has opened the door.

The mailbox to which the invention is to be applied is of the type which is mounted on a post at the roadside so that the postman can draw up to it in an automobile and, without getting out of his car, open the door of the box and deposit mail therein. The house to which the mailbox belongs is always situated back from the road and this means that the owner must walk from the house to the mailbox to get the mail or in any event see if any mail has been left.

As the postman's time of delivery may be quite irregular there is normally no way for the owner to know whether or not the postman has come by and whether or not mail has been deposited. As a result he may walk to the box and find that it is empty because the postman has not been there and this useless trip may be repeated several times. Or, the owner may wait long after the mail has been delivered just to escape making a nonproductive trip.

Mailbox signals have been devised to automatically indicate that the postman has opened the door but they have all been of a complex nature and this has made them expensive in price and/or complicated to apply to the mailbox. For instance, U.S. Pat. No. 2,581,880 granted to L. Price in 1952 shows a plate which is hinged to the underside of the box and which drops when the door is opened. It is complex because it requires the attachment of a special door fixture and requires a pivoted connection for the plate at an accurate location. Various widths of plates are required to fit different sizes of mailboxes.

Similar complex signal schemes are shown in U.S. Pat. No. 3,750,939 issued to E. D. Hallett in 1973 and in U.S. Pat. No. 2,613,031 issued to J. J. Joyce in 1952.

The present invention provides a mailbox signal assembly which has the feature of being a unit of the utmost simplicity. The individual parts of the assembly are readily obtainable from commercial sources or are easily made, as will appear. Because of this the entire unit can be made and sold at a nominal cost.

A foremost feature of the invention is that the unit may easily be attached to a roadside mailbox of all sizes as they are generally of standard construction as required by postal regulations. Moreover, the attachment is readily and quickly made without the requirement of special tools and without any changes in the standard mailbox.

Figure 1:
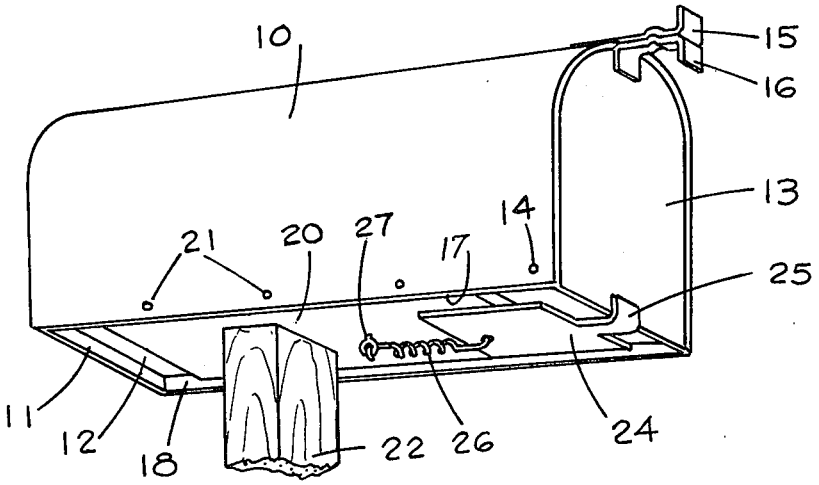
Figure 2:
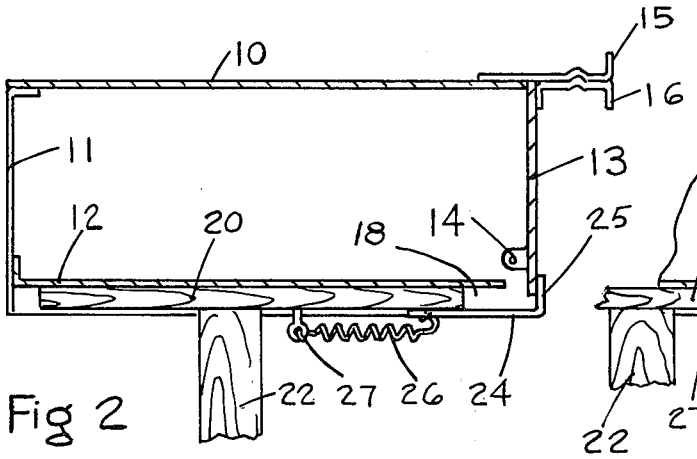
Figure 3:
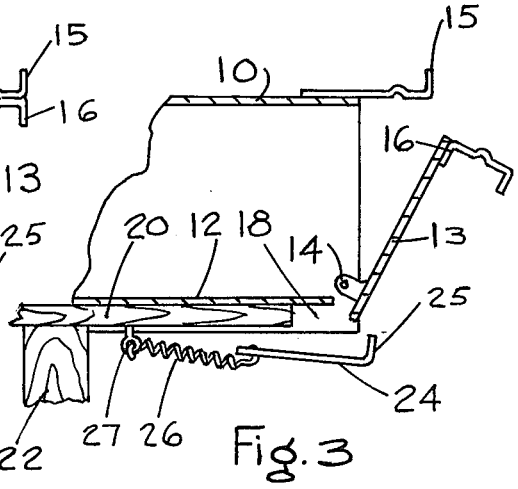
Figure 4:
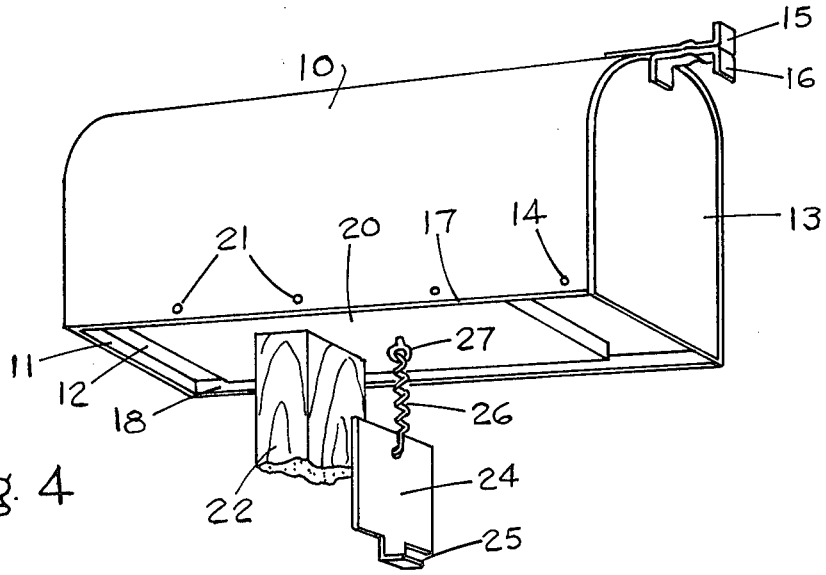

A preferred embodiment of the invention is illustrated in the accompanying drawings in which:

FIG. 1 is a perspective view looking up toward the underside of a mailbox to which the invention has been applied, FIG. 2 is a vertical, transverse sectional view through FIG. 1 some of the parts being in elevation, FIG. 3 is a front end fragment similar to FIG. 2 showing the door partly opened and the signal plate dislodged and FIG. 4 is a view similar to FIG. 1 but showing the signal plate in its display position.

The mailbox is made up of the cover housing or roof 10 of an inverted U-shaped or tunnel formation. It has the fixed rear wall 11 and the fixed floor or bottom plate 12. The front door 13 is pivoted or hinged at 14 so that it can be swung open and reclosed. To hold the door closed the usual latch pieces 15 and 16 are provided. It will be understood that variations in this basic structure are possible, such as the provision of a flat roof top, without impairing the attachment thereto of the unit of this invention.

The floor 12 is generally elevated slightly upwardly within the mailbox so that the housing 10 provides the depending side flanges 17 and 18 below the floor. This forms a recess along the underside of the mailbox from the rear wall 11 to the door 13. Within this recess is a wooden board 20 which extends between the flanges 17 and 18 and is held in place by the nails or screws 21. This board 20 is nailed or otherwise affixed to the top of the road post.

The structure which has been described so far is representative of the conventional mailbox to which the assembly of this invention is to be applied. As has been stated, the signal unit of this invention is attached in a very simple manner to such a standard or conventional mailbox and can be attached as well to variations which will accept the signal unit. No alteration of the mailbox will be required in almost all instances. The manner of attachment is so simple that anyone can accomplish it without tools and with extreme ease, as will appear.

The signal unit of the invention consists of the plate or sheet 24 with its bent lip or tab 25, the tension spring 26 and the screw eye 27. All that is necessary to attach this signal unit to the mailbox is to screw the screw eye 27 up into the board 20 at the proper location, as will be explained.

The plate 24 is preferably of sheet metal as the lip 25 may easily be cut to the desired shape and be bent to right angles with respect to the body of the plate itself. The plate could be made of plastic or of other material which lends itself to this shape. The lip may be inch or two square in size but it may be even smaller or larger. For instance, it could be as wide as the plate itself but if it is relatively small as is shown the signal unit is more easily applied to the door for each set-up. Also, if it is small it is not noticeable on the front of the door.

The spring 26 is most easily attached to the plate by passing it through a hole in the plate which is close to the edge and about midway of the plate width. The spring is attached to the opposite side of the plate from the lip or tab 25. The preferred shape of the plate 24 is square but it can be oblong and it does not even have to be rectangular as it could be rounded in outline.

The tension spring 26 and the screw eye 27 are standard items which are available at all hardware stores. The screw eye serves as an attachment means and it will be clear that an alternative attachment means would be a simple wire or cord which goes around the post 22 and to which the spring 26 is fastened. In like manner the spring and plate could be wired together.

After the screw eye 27 is screwed up in place the plate 24 is brought up against the underside of the board 20 and the lip 25 brought up against the front, lower edge of the door as is shown in FIGS. 1 and 2. The tension of the spring 26 will frictionally hold the lip 25 against and on the front of the door and thereby retain the plate 24 up against or very close to the underside of the board 20. This is the normal stand-by position and the plate is practically out of sight.

The screw eye 27 is located at a point which will put the appropriate tension in the spring so that it will be assured that the plate will not drop down off of the mailbox during each stand-by periods. This location of the screw eye is also, of course, determined by the tension strength of the spring but the proper location is easily achieved. The plate 24 preferably is narrow enough to lie between the side flanges 17 and 18 so as to be somewhat hidden but this is not essential.

When the door is opened as is shown in FIG. 3 the lip 25 is cammed down off of the door and the plate 24 drops downwardly due to gravitational pull. The plate 24 then hangs in the suspended position shown in FIG. 4 and serves as a signal to the box owner that the door has been opened. The owner then goes to the box and takes the mail out and simply restores the plate 24 and its lip 25 to the relationship shown in FIG. 1. The signal unit cannot be lost as it is permanently attached to the box by the spring and its attachment means.

The plate may be painted or striped to make it more noticeable from the house but it may be bare. The lip or tab 25 can be painted to match the color of the door so that its presence will not be obvious from the street. This signal unit does not interfere with the operations of the postman nor does it require any cooperative action by him.

I claim:

1. A signal unit which will drop down to a clearly visible suspended position below a mailbox from a normally hidden location close to the mailbox when the door of the mailbox is opened and dislodges it, which comprises a plate having an upturned lip at one edge to frictionally bear on the door of the mailbox, a tension spring attached at one of its ends to the plate edge opposite from said lip and attachment means for securing the opposite end of the spring to the mailbox to place the spring in tension and draw the lip against the door.

2. The signal unit of claim 1 in which the lip is at right angles to the plate.

3. The signal unit of claim 1 in which the plate is rectangular in shape.

4. The signal unit of claim 1 in which said attachment means is a screw eye.

5. The combination with a roadside mailbox of a signal unit which will indicate that the mailbox door has been opened, said signal unit consisting of a plate which underlies the mailbox in a hidden position, a spring attached to an edge of the plate at one end and to the mailbox at its other end, and an upturned lip at the opposite edge of the plate which frictionally bears on the door under the stress of the spring.

* * * * *